US010138746B2

(12) United States Patent
McMahon

(10) Patent No.: US 10,138,746 B2
(45) Date of Patent: Nov. 27, 2018

(54) GAS TURBINE ENGINE FLOW CONTROL DEVICE

(71) Applicant: UNITED TECHNOLOGIES CORPORATION, Farmington, CT (US)

(72) Inventor: Ryan C. McMahon, Palm Beach Gardens, FL (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 327 days.

(21) Appl. No.: 14/895,513

(22) PCT Filed: Jun. 6, 2014

(86) PCT No.: PCT/US2014/041234
§ 371 (c)(1),
(2) Date: Dec. 3, 2015

(87) PCT Pub. No.: WO2014/200830
PCT Pub. Date: Dec. 18, 2014

(65) Prior Publication Data

US 2016/0130964 A1 May 12, 2016

Related U.S. Application Data

(60) Provisional application No. 61/834,981, filed on Jun. 14, 2013.

(51) Int. Cl.
*F01D 11/00* (2006.01)
*F01D 25/12* (2006.01)
(Continued)

(52) U.S. Cl.
CPC ..... *F01D 11/003* (2013.01); *F01D 11/005* (2013.01); *F01D 25/12* (2013.01);
(Continued)

(58) Field of Classification Search
CPC ..... F01D 11/003; F01D 11/005; F01D 25/12; F01D 11/08; F01D 11/20; F01D 11/24; F01D 25/14; F01D 25/24; F05D 25/246
(Continued)

(56) References Cited

U.S. PATENT DOCUMENTS 3,941,500 A 3/1976 Glenn
4,109,864 A 8/1978 Clayton
(Continued)

OTHER PUBLICATIONS

Extended European Search Report for European Application No. 14810898.8 dated Jan. 4, 2017.
(Continued)

*Primary Examiner* — Logan Kraft
*Assistant Examiner* — Justin A Pruitt
(74) *Attorney, Agent, or Firm* — Carlson, Gaskey & Olds, P.C.

(57) ABSTRACT

A flow control device for a gas turbine engine according to an exemplary aspect of the present disclosure includes, among other things, a seal body having a radially inner surface and a radially outer surface and at least one stand-up protruding from the radially outer surface and configured to seal an interrupted surface.

18 Claims, 4 Drawing Sheets

(51) Int. Cl.
*F01D 25/24* (2006.01)
*F01D 11/24* (2006.01)

(52) U.S. Cl.
CPC ..... *F01D 25/246* (2013.01); *F01D 11/24* (2013.01); *F05D 2220/32* (2013.01)

(58) Field of Classification Search
USPC ..... 415/214.1
See application file for complete search history.

(56) References Cited

U.S. PATENT DOCUMENTS

| | | | | |
|---|---|---|---|---|
| 4,767,267 | A | 8/1988 | Salt et al. | |
| 5,320,486 | A | 6/1994 | Walker et al. | |
| 7,771,160 | B2 * | 8/2010 | Shi | F01D 9/04 415/138 |
| 9,752,592 | B2 * | 9/2017 | Sippel | F04D 29/522 |
| 2003/0161727 | A1 | 8/2003 | MacLean et al. | |
| 2004/0120814 | A1 | 6/2004 | Brainch et al. | |
| 2004/0136844 | A1 * | 7/2004 | Dewis | F01D 5/081 417/407 |

OTHER PUBLICATIONS

International Search Report and Written Opinion of the International Searching Authority for International application No. PCT/US2014/041234 dated Sep. 29, 2014.
International Preliminary Report on Patentability for International application No. PCT/US2014/041234 dated Dec. 23, 2015.

* cited by examiner

GAS TURBINE ENGINE FLOW CONTROL DEVICE

BACKGROUND

This disclosure relates to a gas turbine engine, and more particularly to a flow control device for sealing an interrupted surface of a gas turbine engine part.

Gas turbine engines typically include at least a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

Some gas turbine engine components include interrupted surfaces that may relieve thermal stresses that exist in full hoop components. Although advantageous for reducing such thermal stresses, the interrupted surfaces are often a source of unwanted fluid leakage. Finger seals have been used in an effort to reduce unwanted flow leakage; however, further contributions in this area of technology are desired.

SUMMARY

A flow control device for a gas turbine engine according to an exemplary aspect of the present disclosure includes, among other things, a seal body having a radially inner surface and a radially outer surface and at least one stand-up protruding from the radially outer surface and configured to seal an interrupted surface.

In a further non-limiting embodiment of the foregoing flow control device, the seal body is a full hoop structure.

In a further non-limiting embodiment of either of the foregoing flow control devices, a plurality of stand-ups protrude from the radially outer surface.

In a further non-limiting embodiment of any of the foregoing flow control devices, the plurality of stand-ups are equidistantly and circumferentially spaced about the seal body.

In a further non-limiting embodiment of any of the foregoing flow control devices, a first axial width of the seal body is greater than a second axial width of the at least one stand-up.

In a further non-limiting embodiment of any of the foregoing flow control devices, the at least one stand-up includes a leading edge having an angled surface that extends in a direction toward a trailing edge of the at least one stand-up.

In a further non-limiting embodiment of any of the foregoing flow control devices, a cooling opening extends through the at least one stand-up and the seal body.

In a further non-limiting embodiment of any of the foregoing flow control devices, the at least one stand-up blocks a leakage path that extends through the interrupted surface.

In a further non-limiting embodiment of any of the foregoing flow control devices, the seal body is a metallic structure.

In a further non-limiting embodiment of any of the foregoing flow control devices, the at least one stand-up is a splined surface of the seal body.

A gas turbine engine according to an exemplary aspect of the present disclosure includes, among other things, a casing defining at least one interrupted surface and a flow control device press fit into the casing. The flow control device includes at least one stand-up configured to plug the at least one interrupted surface.

In a further non-limiting embodiment of the foregoing gas turbine engine, the flow control device is employed within a compressor section of the gas turbine engine.

In a further non-limiting embodiment of either of the foregoing gas turbine engines, the flow control device is employed within a turbine section of the gas turbine engine.

In a further non-limiting embodiment of any of the foregoing gas turbine engines, the flow control device is positioned radially between the casing and a static structure.

In a further non-limiting embodiment of any of the foregoing gas turbine engines, the flow control device includes a seal body and the at least one stand-up protrudes from a radially outer surface of the seal body.

In a further non-limiting embodiment of any of the foregoing gas turbine engines, a portion of the seal body is received against an inner surface of the casing.

In a further non-limiting embodiment of any of the foregoing gas turbine engines, the at least one stand-up blocks a leakage path through the at least one interrupted surface.

A method according to another exemplary aspect of the present disclosure includes, among other things, plugging an interrupted surface of a casing with a portion of a flow control device and blocking a leakage path through the interrupted surface with the portion.

In a further non-limiting embodiment of the foregoing method, the method comprises communicating a cooling fluid through a cooling opening that extends through the flow control device.

In a further non-limiting embodiment of either of the foregoing methods, the method of plugging includes press fitting the flow control device into the casing.

The various features and advantages of this disclosure will become apparent to those skilled in the art from the following detailed description. The drawings that accompany the detailed description can be briefly described as follows.

DETAILED DESCRIPTION

This disclosure is directed to a gas turbine engine flow control device that may be employed to seal an interrupted surface of a relatively hot section of the gas turbine engine. The exemplary flow control device of this disclosure simultaneously plugs the interrupted surface, blocks leakage paths, and reduces thermal stresses in the hot section. These and other features are described in detail herein.

Figure 1:
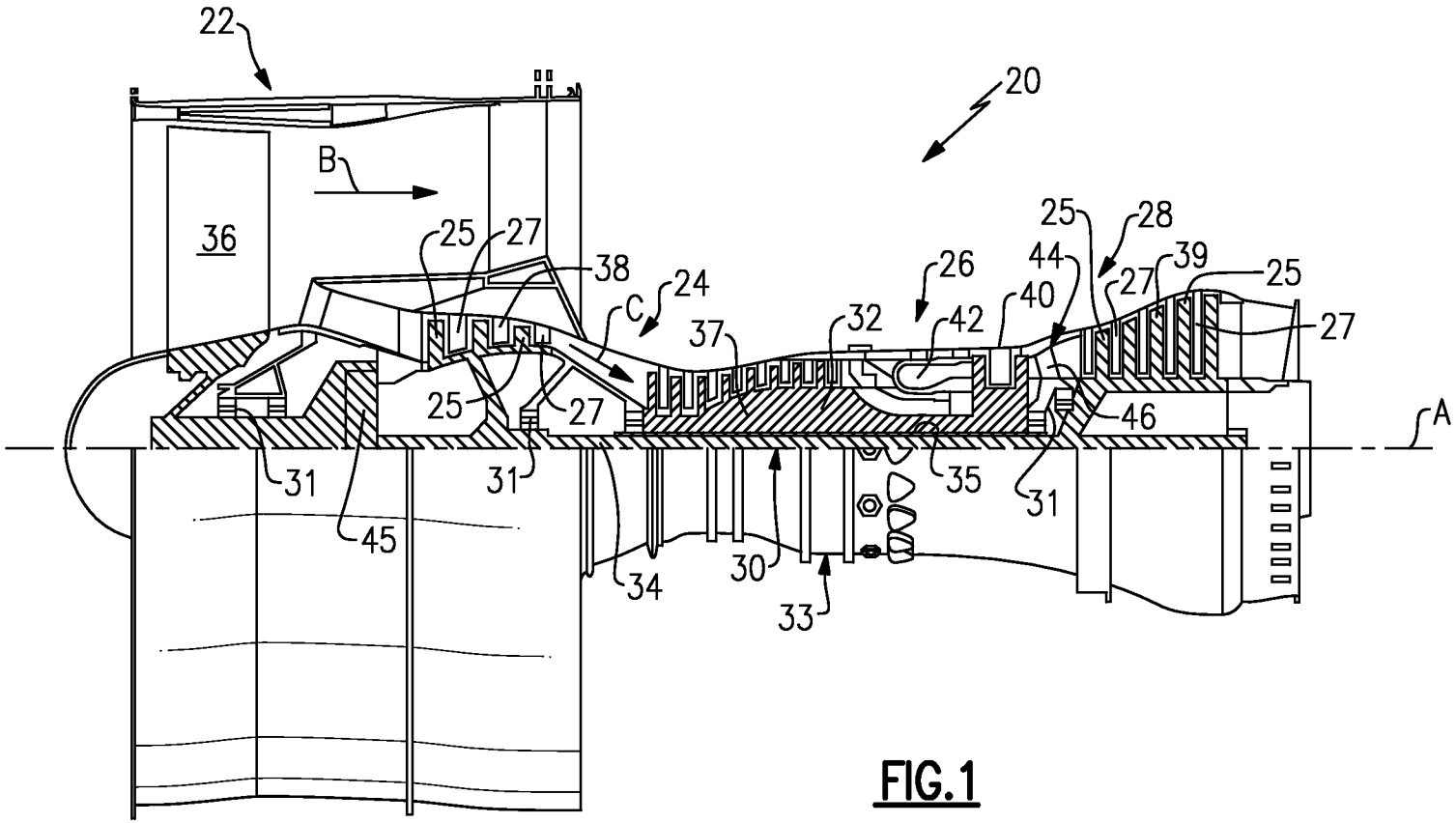
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures as well as industrial gas turbine engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Figure 2:
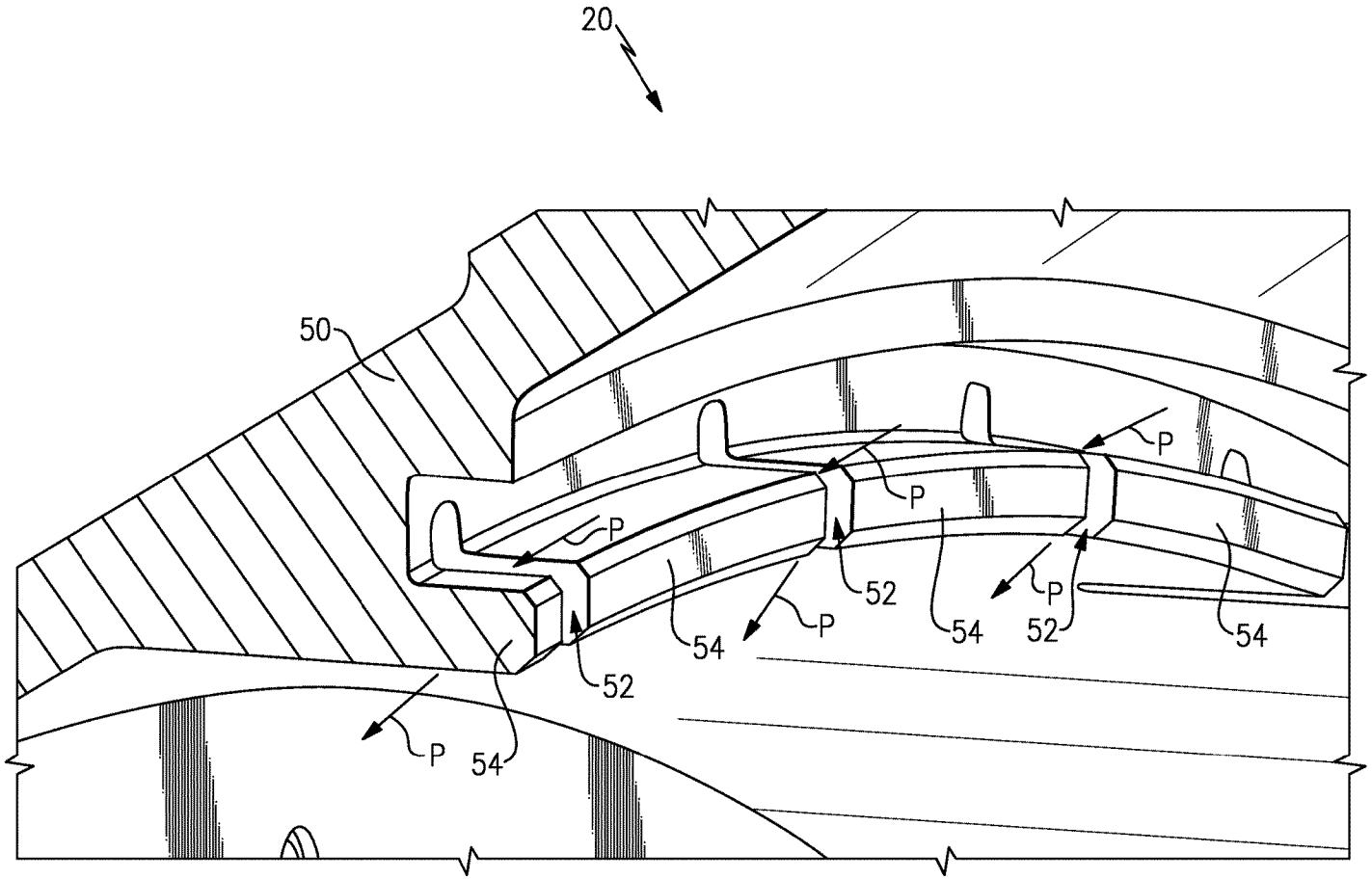
FIG. 2 illustrates a gas turbine engine casing.

FIG. 2 illustrates a casing 50 of a gas turbine engine, such as the gas turbine engine 20 of FIG. 1. In this disclosure, the term "casing" is intended to denote any relatively hot section, part or component of the gas turbine engine 20. For example, without limiting this disclosure, the casing 50 may be an outer casing of the compressor section 24, the turbine section 28, or any other portion of the gas turbine engine 20.

The casing 50 defines a plurality of interrupted surfaces 52 that establish leakage paths P through the casing 50. The leak paths P are openings that permit the flow of fluid, such as bleed air, from neighboring pressurized cavities. In one embodiment, the casing 50 includes a plurality of hooks 54 that are separated by the interrupted surfaces 52. The hooks 54 may be arranged and configured for receiving another structure(s), such as a vane assembly, to assemble the gas turbine engine 20.

In one embodiment, the interrupted surfaces 52 are slotted openings or gaps in the casing 50. A flow control device that can be used to seal the interrupted surfaces 52 is described in greater detail below.

Figure 3:
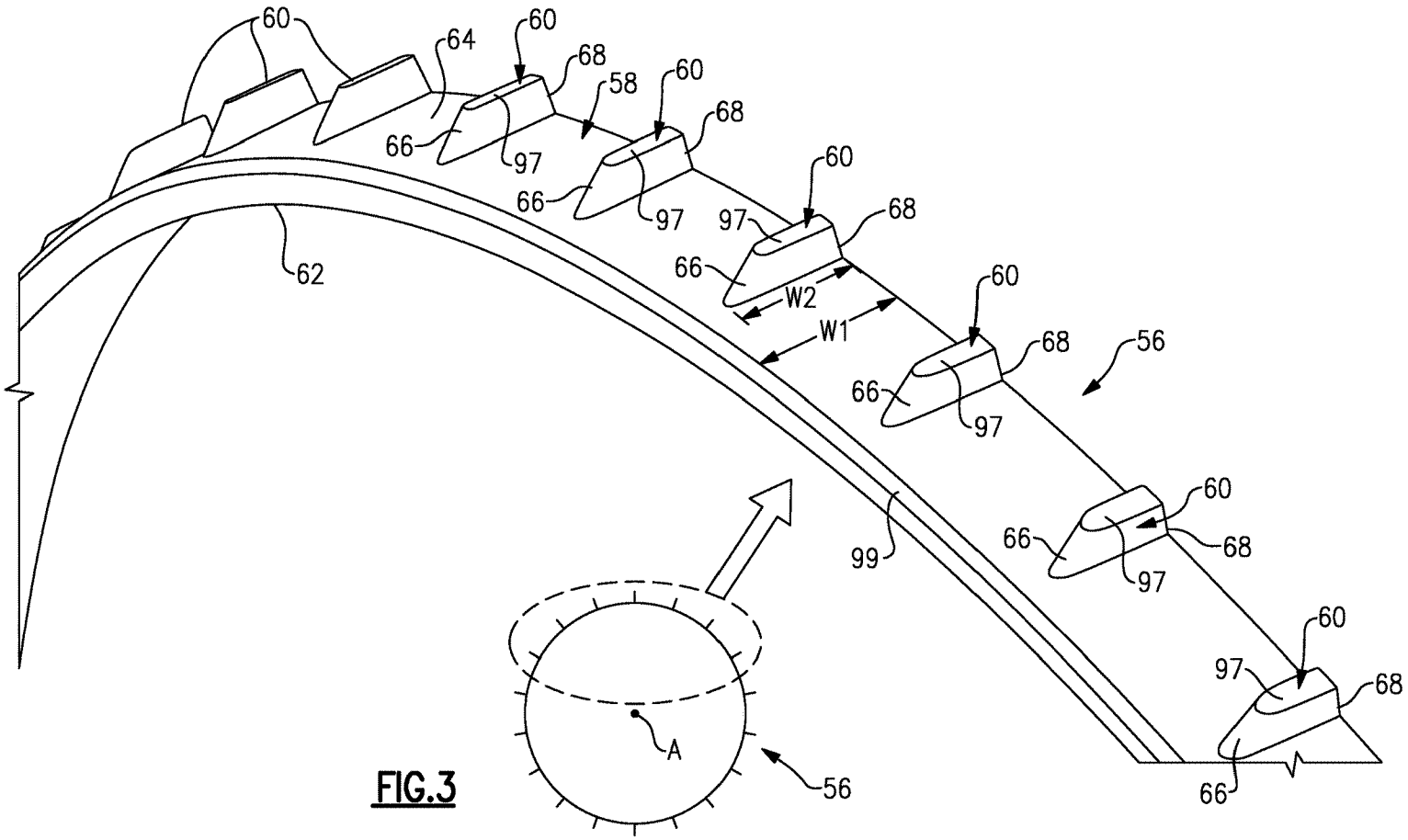
FIG. 3 illustrates an exemplary flow control device that can be employed within a gas turbine engine.

An exemplary flow control device 56 that can be employed to "plug" one or more interrupted surfaces is illustrated in FIG. 3. The flow control device 56 includes a seal body 58 having a radially inner surface 62 and a radially outer surface 64. One or more stand-ups 60 protrude from the seal body 58. The actual number of stand-ups 60 will depend on the number of interrupted surfaces that must be sealed.

In one embodiment, the flow control device 56 includes a plurality of stand-ups 60 that extend outwardly from the radially outer surface 64. The stand-ups 60 may be equidistantly and circumferentially spaced about the seal body 58. This disclosure is not intended to be limited to the exact configuration shown by FIG. 3. The actual design of the flow control device 56 may depend on the number and size of interrupted surfaces that require sealing.

In one embodiment, the flow control device 56 is a full hoop structure made of a metallic material. The flow control device 56 may be circumferentially disposed about the engine centerline longitudinal axis A. Exemplary materials that can be used to manufacture the flow control device 56 include nickel alloys and refractory metals. However, other materials are also contemplated as within the scope of this disclosure.

Each stand-up 60 of the flow control device 56 includes a leading edge 66 and a trailing edge 68. In one embodiment, the leading edge 66 of each stand-up 60 is an angled surface that extends in a direction toward the trailing edge 68. The stand-ups 60 may be referred to as splined surfaces of the seal body 58. The stand-ups 60 are machined into the seal body 58, in one embodiment. The stand-ups 60 may embody a trapezoidal shape or any other shape.

In one embodiment, the seal body 58 defines a first axial width W1 and the stand-ups 60 define a second axial width W2 that is less than the first axial width of the seal body 58. In other words, the stand-ups 60 terminate prior to an edge 99 of the seal body 58 (here, a leading edge). The stand-ups 60 may additionally define top surfaces 97 that are substantially flat.

Figure 4:
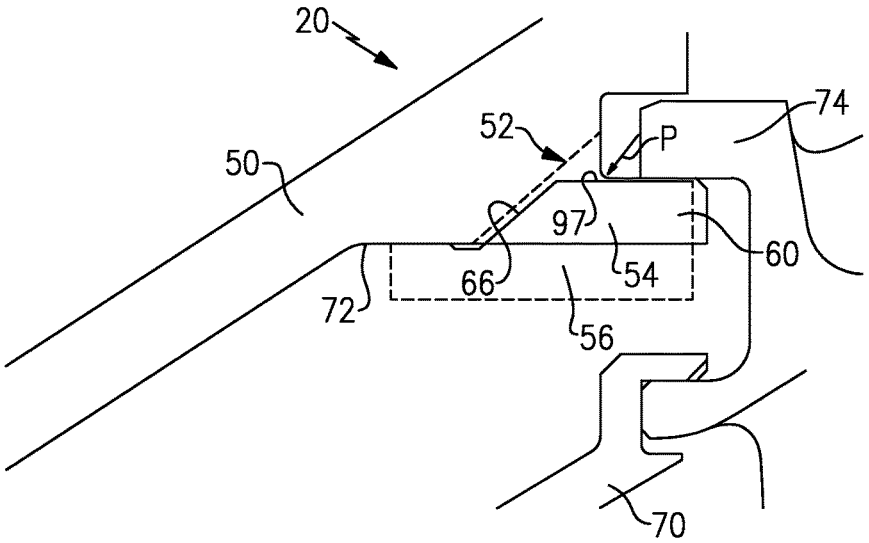
FIG. 4 illustrates a cross-sectional view of an exemplary flow control device mounted within a gas turbine engine.

FIG. 4 illustrates the flow control device 56 in a mounted position within the gas turbine engine 20. In one embodiment, the flow control device 56 is press fit into the casing 50 to provide an interference fit. The press fit relationship between the flow control device 56 and the casing 50 substantially reduces or eliminates relative motion between the two parts, thereby reducing wear. The flow control device 56 could additionally or alternatively be tack welded to the casing 50. Once appropriately positioned, the flow control device 56 substantially plugs the interrupted surfaces 52 of the casing 50.

In the mounted position, the seal body 58 of the flow control device 56 is received against an inner surface 72 of the casing 50. The stand-ups 60 of the flow control device 56 extend through the interrupted surfaces 52 between the hooks 54 of the casing 50. Put another way, the stand-ups 60 are received within the gaps that are defined by the interrupted surfaces 52 between the hooks 54. In one embodiment, the leading edges 66 of the stand-ups 60 are parallel to the angle of extension of the interrupted surfaces 52. The top surfaces 97 of the stand-ups 60 may contact a flange 74 of an adjacent component, such as an adjacent vane assembly.

A leakage path P that may extend through the casing 50 is substantially blocked by the flow control device 56. For example, the stand-ups 60 of the flow control device 56 fill the open spaces defined by the interrupted surfaces 52 to seal off the leakage path P.

In one embodiment, the flow control device 56 is positioned radially between the casing 50 and a static structure 70. The static structure 70 may be a transition duct or any other static structure.

Figure 5:
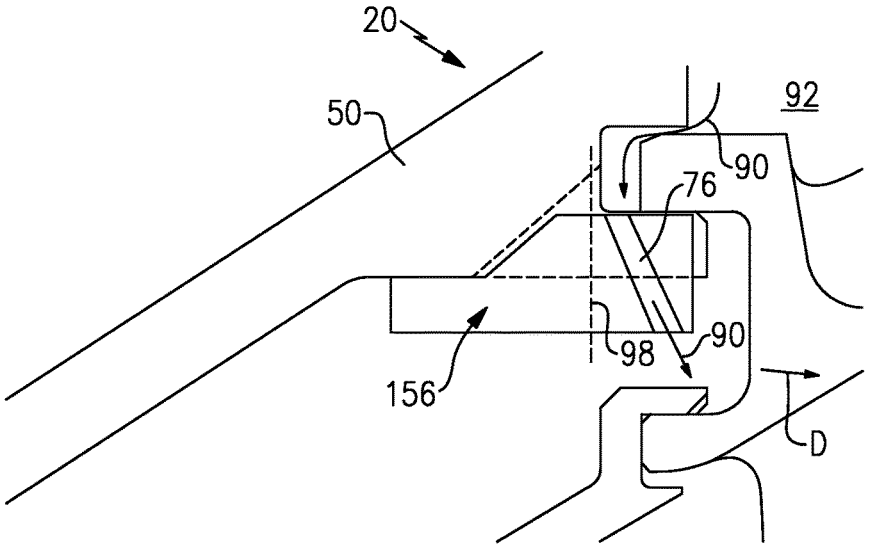
FIG. 5 illustrates a cross-sectional view of another embodiment of a mounted flow control device.

FIG. 5 illustrates another exemplary flow control device 156, which is shown in a mounted position within the gas turbine engine 20. In this disclosure, like reference numerals designate like elements where appropriate and reference numerals with the addition of 100 or multiples thereof designate modified elements that are understood to incorporate the same features and benefits of the corresponding original elements.

In this embodiment, the flow control device 156 includes one or more cooling openings 76 that extend radially through the flow control device 156. For example, at least one cooling opening 76 may extend through each stand-up 60 and the seal body 58 to provide a conduit for communicating a cooling fluid 90 through the flow control device 156. The cooling fluid 90 may be communicated from a pressurized cavity 92 that is fed with pressurized cooling airflow, such as bleed airflow from the compressor section. The cooling fluid 90 may cool the relatively hot surfaces of surrounding components of the gas turbine engine 20.

In one embodiment, the cooling opening 76 is obliquely angled relative to a radial axis 98 that extends through the flow control device 56. The cooling opening 76 may obliquely extend in a downstream direction D of the gas turbine engine 20.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A gas turbine engine, comprising:

a casing defining at least one interrupted surface; and a flow control device press fit into said casing, wherein said flow control device includes at least one stand-up configured to plug said at least one interrupted surface, wherein said flow control device is positioned radially between said casing and a static structure.

2. The gas turbine engine as recited in claim 1, wherein said flow control device is employed within a compressor section of the gas turbine engine.

3. The gas turbine engine as recited in claim 1, wherein said flow control device is employed within a turbine section of the gas turbine engine.

4. The gas turbine engine as recited in claim 1, wherein said flow control device includes a seal body and said at least one stand-up protrudes from a radially outer surface of said seal body.

5. The gas turbine engine as recited in claim 4, wherein a portion of said seal body is received against an inner surface of said casing.

6. The gas turbine engine as recited in claim 1, wherein said at least one stand-up blocks a leakage path through said at least one interrupted surface.

7. The gas turbine engine as recited in claim 1, wherein the static structure is a transition duct.

8. The gas turbine engine as recited in claim 1, wherein a top surface of the stand-up contacts an adjacent vane assembly.

9. A method, comprising:

plugging a plurality of circumferentially spaced interrupted surfaces of a casing with a plurality of circumferentially spaced stand-ups of a flow control device, including press fitting the flow control device into the casing; and blocking a leakage path through the plurality of interrupted surfaces with the plurality of circumferentially spaced stand-ups.

10. The method as recited in claim 9, comprising communicating a cooling fluid through a cooling opening that extends through the flow control device.

11. An assembly for a gas turbine engine, comprising:

a casing defining a plurality of hooks configured to receive a vane assembly and separated circumferentially by a plurality of interrupted surfaces; and a flow control device including a seal body having a radially inner surface, a radially outer surface, and a plurality of stand-ups protruding from the radially outer surface, wherein the plurality of stand-ups are received in the plurality of interrupted surfaces for sealing.

12. The assembly as recited in claim 11, wherein said seal body is a metallic structure.

13. The assembly as recited in claim 11, wherein said each of the plurality of stand-ups blocks a leakage path that extends through an associated one of the plurality of interrupted surfaces.

14. The assembly as recited in claim 11, wherein the seal body defines a first axial width, and the plurality of stand-ups define a second axial width less than the first axial width.

15. The assembly as recited in claim 11, wherein the seal body is a full hoop structure.

16. The assembly as recited in claim 11, wherein each of the plurality of stand-ups includes a leading edge having an angled surface.

17. The assembly as recited in claim 11, wherein a cooling opening extends through at least one of the plurality of stand-ups and the seal body.

18. An assembly for a gas turbine engine, comprising:

a casing defining a plurality of hooks separated circumferentially by a plurality of interrupted surfaces; and a flow control device including a seal body having a radially inner surface, a radially outer surface, and a plurality of stand-ups protruding from the radially outer surface, wherein the plurality of stand-ups are received in the plurality of interrupted surfaces for sealing, wherein the flow control device is press fit into the casing.

* * * * *